US008614384B2

(12) United States Patent
Hotrique

(10) Patent No.: US 8,614,384 B2
(45) Date of Patent: Dec. 24, 2013

(54) KEYBOARD FOR MUSICAL INSTRUMENT, AND INSTRUMENT COMPRISING SUCH A KEYBOARD

(76) Inventor: Julien Hotrique, Aubervilliers (FR)

( * ) Notice: Subject to any disclaimer, the term of this patent is extended or adjusted under 35 U.S.C. 154(b) by 0 days.

(21) Appl. No.: 13/263,443

(22) PCT Filed: Apr. 12, 2010

(86) PCT No.: PCT/FR2010/000300

§ 371 (c)(1),
(2), (4) Date: Oct. 7, 2011

(87) PCT Pub. No.: WO2010/119188

PCT Pub. Date: Oct. 21, 2010

(65) Prior Publication Data

US 2012/0031254 A1 Feb. 9, 2012

(30) Foreign Application Priority Data

Apr. 14, 2009 (FR) ..... 09 01802

(51) Int. Cl.
*G10C 3/12* (2006.01)

(52) U.S. Cl.
USPC ..... 84/423 R; 84/376 R

(58) Field of Classification Search
USPC ..... 84/423 R, 376 R
See application file for complete search history.

(56) References Cited

U.S. PATENT DOCUMENTS

| | | | | | |
|---|---|---|---|---|---|
| 370,218 | A | * | 9/1887 | Stratton | 84/376 R |
| 530,605 | A | * | 12/1894 | Schpanowsky | 84/376 A |
| 826,661 | A | * | 7/1906 | Hofbauer | 84/376 K |
| 2,003,894 | A | * | 6/1935 | Luedtke | 84/423 R |
| 3,012,460 | A | * | 12/1961 | Wilson | 84/423 R |
| 3,067,645 | A | * | 12/1962 | Moschino | 84/376 R |
| 3,311,011 | A | * | 3/1967 | Kuehl | 84/376 K |
| 3,468,209 | A | * | 9/1969 | Barreto | 84/423 R |
| 3,776,089 | A | * | 12/1973 | Cohen | 84/376 R |
| 4,031,800 | A | * | 6/1977 | Thompson | 84/423 R |
| 4,159,664 | A | * | 7/1979 | Mastronardi | 84/376 R |

(Continued)

FOREIGN PATENT DOCUMENTS

| | | |
|---|---|---|
| DE | 35 34 961 A1 | 4/1987 |
| DE | 200 09 090 U1 | 8/2000 |
| WO | 2006/050577 A1 | 5/2006 |

OTHER PUBLICATIONS

International Search Report, dated Apr. 29, 2011, from corresponding PCT application.

*Primary Examiner* — David Warren
*Assistant Examiner* — Robert W Horn
(74) *Attorney, Agent, or Firm* — Young & Thompson

(57) ABSTRACT

A polyphonic, chromatic keyboard, whose notes are alternately distributed across two sub-keyboards arranged in thirds on each sub-keyboard. On each sub-keyboard, the notes are distributed across a tiling of basic triangles that is symmetrical from one sub-keyboard to the other and that peaks at one note, i.e. the major third thereof, and the minor third thereof. Thus, the quality of an interval, and consequently that of a chord or mode, does not vary with a nearby symmetry/translation. The harmonic material is represented by easily memorizable shapes. The relationships between chords are represented by geometrical movements. The keyboard can thus be a pedagogical aid for learning and understanding harmonic rules. The keyboard enables the user to play a bass line and a harmonic or melodic accompaniment simultaneously, feel the harmonic rhythm, and play with virtuosity. The keyboard can be fit onto a portable instrument, thus making it possible to play comfortably.

15 Claims, 7 Drawing Sheets

(56) References Cited

U.S. PATENT DOCUMENTS

Figure 4:
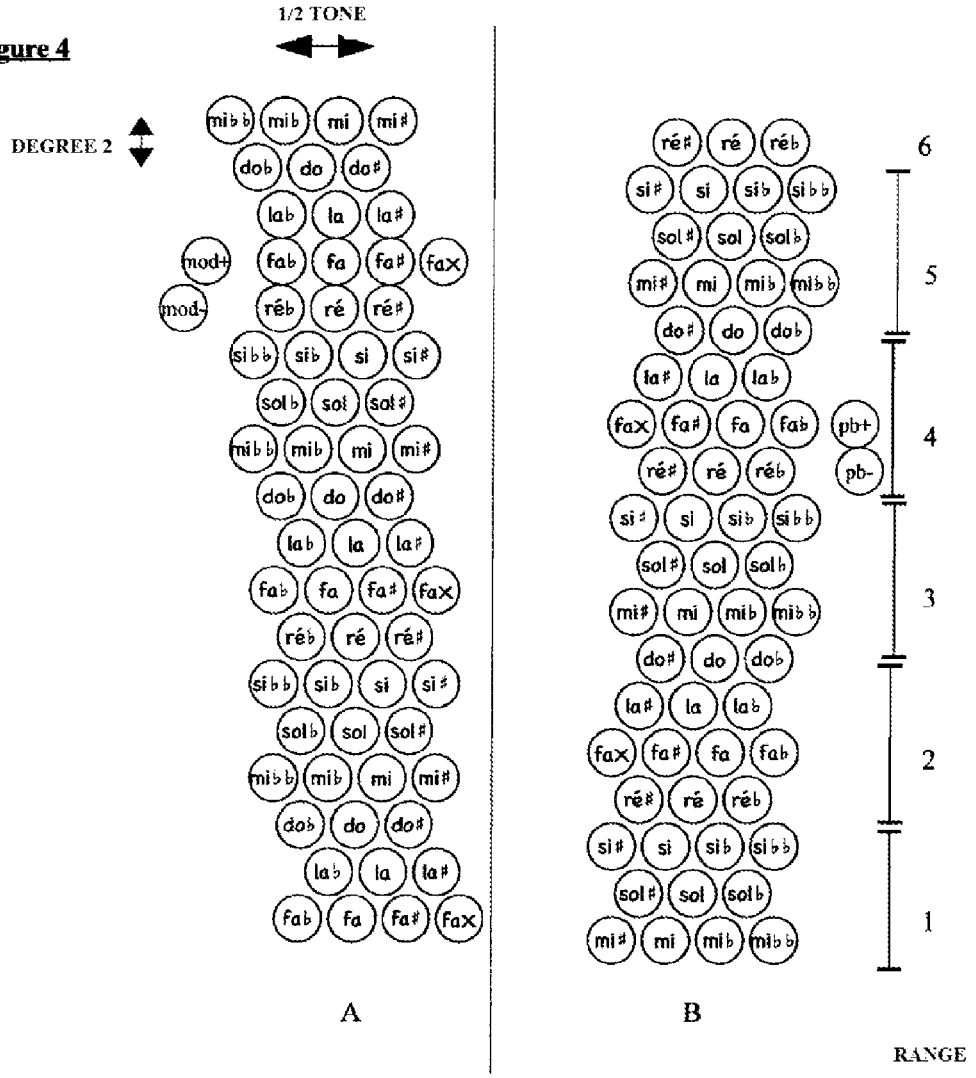

| | | | | |
|---|---|---|---|---|
| 5,415,071 | A * | 5/1995 | Davies | 84/471 SR |
| 5,741,990 | A * | 4/1998 | Davies | 84/423 R |
| 6,392,131 | B2 * | 5/2002 | Boyer | 84/424 |
| 6,670,535 | B2 * | 12/2003 | Anderson et al. | 84/443 |
| 6,703,552 | B2 * | 3/2004 | Haken | 84/658 |
| 7,667,119 | B1 * | 2/2010 | Schlapkohl | 84/424 |
| 2009/0114078 | A1 * | 5/2009 | Plamondon | 84/423 R |
| 2012/0031254 | A1 * | 2/2012 | Hotrique | 84/423 R |

* cited by examiner figure 1
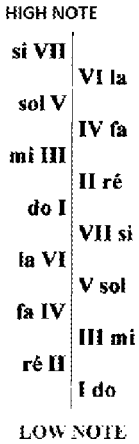
figure 2.1
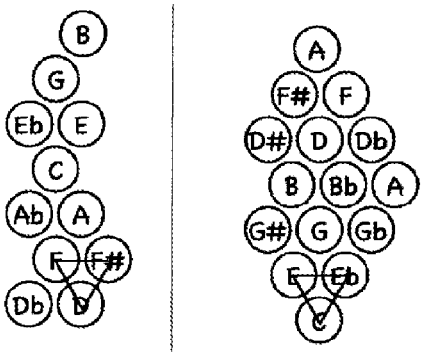
A B
figure 2.2
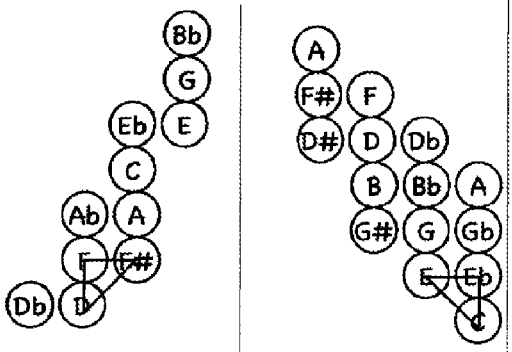
A B
figure 2.3
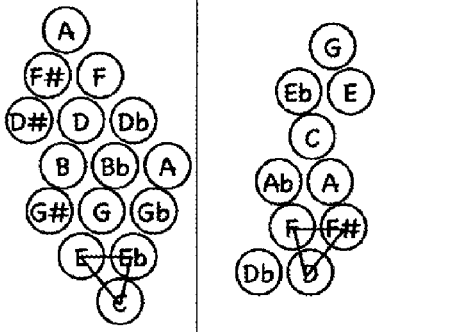
A B
figure 3
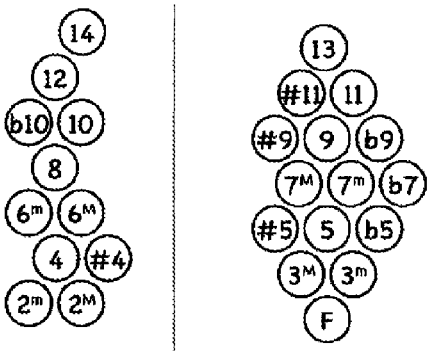
A B

LOW NOTE

B

A

HIGH NOTE figure 8
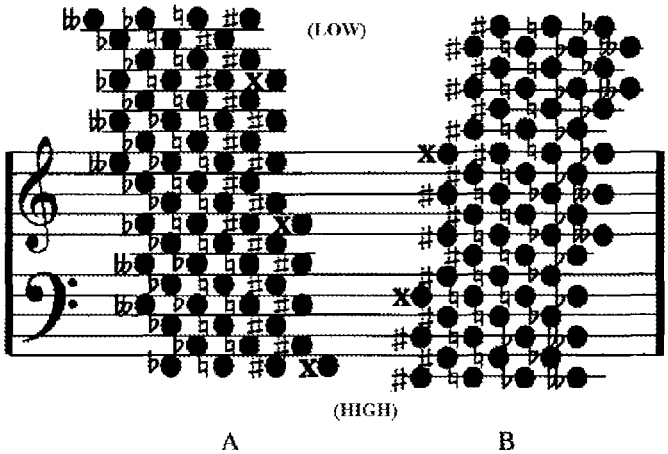
figure 9
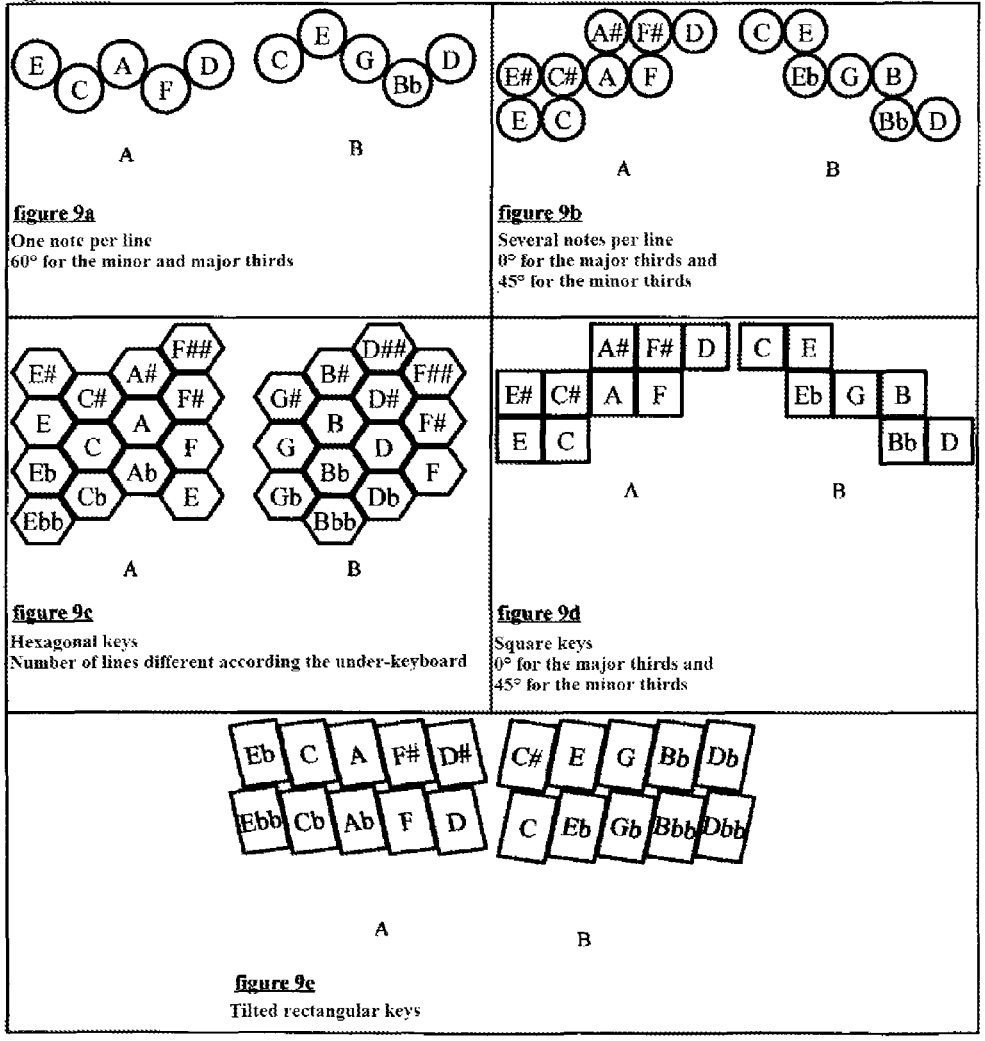
figure 9a
One note per line
60° for the minor and major thirds
figure 9b
Several notes per line
0° for the major thirds and
45° for the minor thirds
figure 9c
Hexagonal keys
Number of lines different according the under-keyboard
figure 9d
Square keys
0° for the major thirds and
45° for the minor thirds
figure 9e
Tilted rectangular keys figure 12
figure 12.1
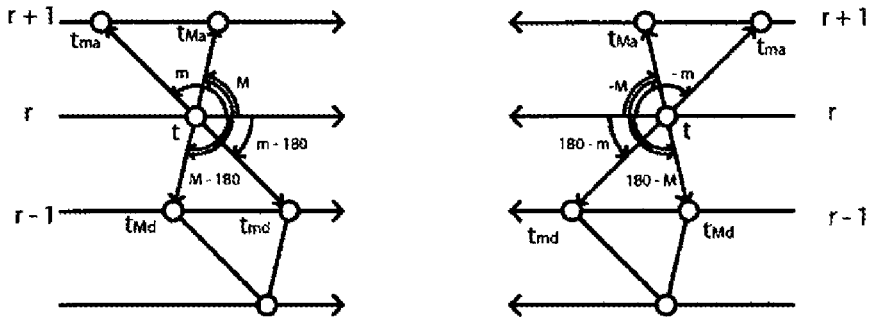
Underkeyboard A
Underkeyboard B
figure 12.2
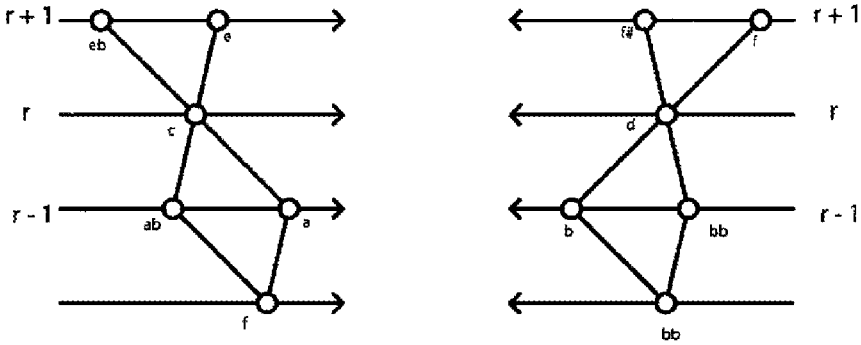
Underkeyboard A
Underkeyboard B

KEYBOARD FOR MUSICAL INSTRUMENT, AND INSTRUMENT COMPRISING SUCH A KEYBOARD

TECHNICAL FIELD OF THE INVENTION

The present invention relates to a keyboard for musical instrument. Such a keyboard can be used for any kinds of musical instruments, such as acoustic, electro-acoustic or electric instruments, using a keyboard. The keyboard according to the invention includes devices, such as keys, each of them controlling the emission of only one note. These devices are, according to the purpose of the instrument, actionable with the fingers, the hands or the feet. To produce sounds, the keyboard can control any system allowing the emission of notes, such as vibrating strings (beaten, struck or pinched strings), vibrating plates (out of wood or metal), skins, glasses, pipes with sheers, free sheers, an electronic system such as a MIDI controller, etc.

The keyboard according to the invention is a keyboard called "position keyboard", i.e. the transposition according to a certain interval boils down to make a geometrical translation of a vector corresponding to this interval, identical for all the keys of the keyboard. In other words, a tuning quality is represented in the present invention by only one geometrical position which can be easily memorized. In a harmonic context. the degrees are alternatively distributed on either side of the keyboard, according to their parity (see FIG. 1).

The keyboard according to this invention thus induces a geometrical representation of the relations between chords. As those relations are considered as fundamental for the analysis of the modal music and the tonal music, that is to say a very broad part of Western music, the present invention can be a teaching support for the training and the comprehension of the harmonic rules. It allows the user of this invention to play a progression of low notes and a harmonic or melody accompaniment at the same time. It also enables him/her to feel the harmonic rhythm and to play with a great virtuosity. It is also directly connected to the traditional Western notation of the music, which facilitates the reading of it.

Thus, the invention relates to a keyboard for musical instrument, including a first under-keyboard and a second under-keyboard, each keyboard including a plurality of keys whose actuation is able to control the emission of a sound corresponding to a note of music, keyboard in which (see FIG. 12)

each under-keyboard includes at least four parallel and equidistant lines, oriented in the same direction, each line including at least one key, and the distance between the lines being identical for both under-keyboards;

the arrangement of the keys, and thus the distribution of the notes controlled by the keyboard, being such as:

on the first under-keyboard [respectively on the second under-keyboard], for each key (t) controlling a note (n), and located on a line (r) arranged between an adjacent lower line (r−1) and an adjacent upper line (r+1), there is:

on the adjacent upper line (r+1)

a key (tMa) actuating the upward major third of (n), this key being arranged so that the half-line starting from the key (t) and passing through the key (tMa) forms a first oriented angle (M), [respectively an angle (−M) opposite the first angle (M) on the second under-keyboard (B)], with the oriented line (r); the value of the first angle (M) belonging to the interval ]0°, 90°];

and/or a key (tma) actuating the upward minor third of the note (n), this key being arranged so that the half-line starting from the key (t) and passing through the key (tma) forms a second oriented angle (m) [respectively an angle (−m) opposite the second angle (m) on the second under-keyboard], with the oriented line (r), the value of the second angle (m) belonging to the interval [90°, 180°[, and being different from the value of the first angle (M);

on the adjacent lower line (r−l)

a key (tMd) actuating the downward major third of the note (n), this key being arranged so that the half-line starting from the key (t) and passing through the key (tMd) forms an oriented angle opposite the supplementary angle (M−180) of the first angle (M) [respectively the supplementary angle (180−M) of the first angle (M) on the second under-keyboard] with the oriented line (r);

and/or a key (tmd) actuating the upward minor third of the note (n), this key being arranged so that the half-line starting from the key (t) and passing through the key (tmd) forms an oriented angle opposite the supplementary angle (m−180) of the second oriented angle (m) [respectively the supplementary angle (180−m) of the second angle (m) on the second under-keyboard], with the oriented line (r);

and on the first under-keyboard [respectively the second under-keyboard], for each key actuating a note (n), there is on the second under-keyboard [respectively the first under-keyboard]:

a key actuating the upward major second of the note (n)

and/or a key actuating the downward major second of the note (n)

so that the notes are alternatively distributed from one under-keyboard to the other, being arranged by thirds on each of them.

See FIG. 9 showing various embodiments of the keyboard according to this invention.

In an embodiment, the under-keyboards are located in two secant planes such as the projection, on the bisecting plane for these two planes, of each key of one of the under-keyboards controlling a note (n) is located between the projection onto this same plane of two lines of the other under-keyboard, these two lines respectively including a key (t1) actuating the upward major second of the note (n) and a key (t2) actuating the downward major second of the note (n).

In an embodiment, the value of the first angle (M) is equal to 60 degrees, and the value of the second angle (m) is equal to 120 degrees.

In an embodiment, the keys are sensitive to the force and/or the swiftness of actuation.

In an embodiment, an electronic device makes it possible to vary the intensity of the emitted sound according to the force and/or the swiftness of actuation of the keys.

In an embodiment, both under-keyboards are each arranged on a flat surface, the angle between the front faces of both under-keyboards belonging to the interval [180°, 270°].

The invention also relates to a musical instrument including a keyboard such as defined above.

In an embodiment, this instrument comprises a sound generator of the expander type of the MIDI standard.

In an embodiment a first device makes it possible to vary the pitch bend, upward and downward, and a second device controls a modulation serrated roller, which thus increases and lowers the effect obtained with the first device.

Figure 10:
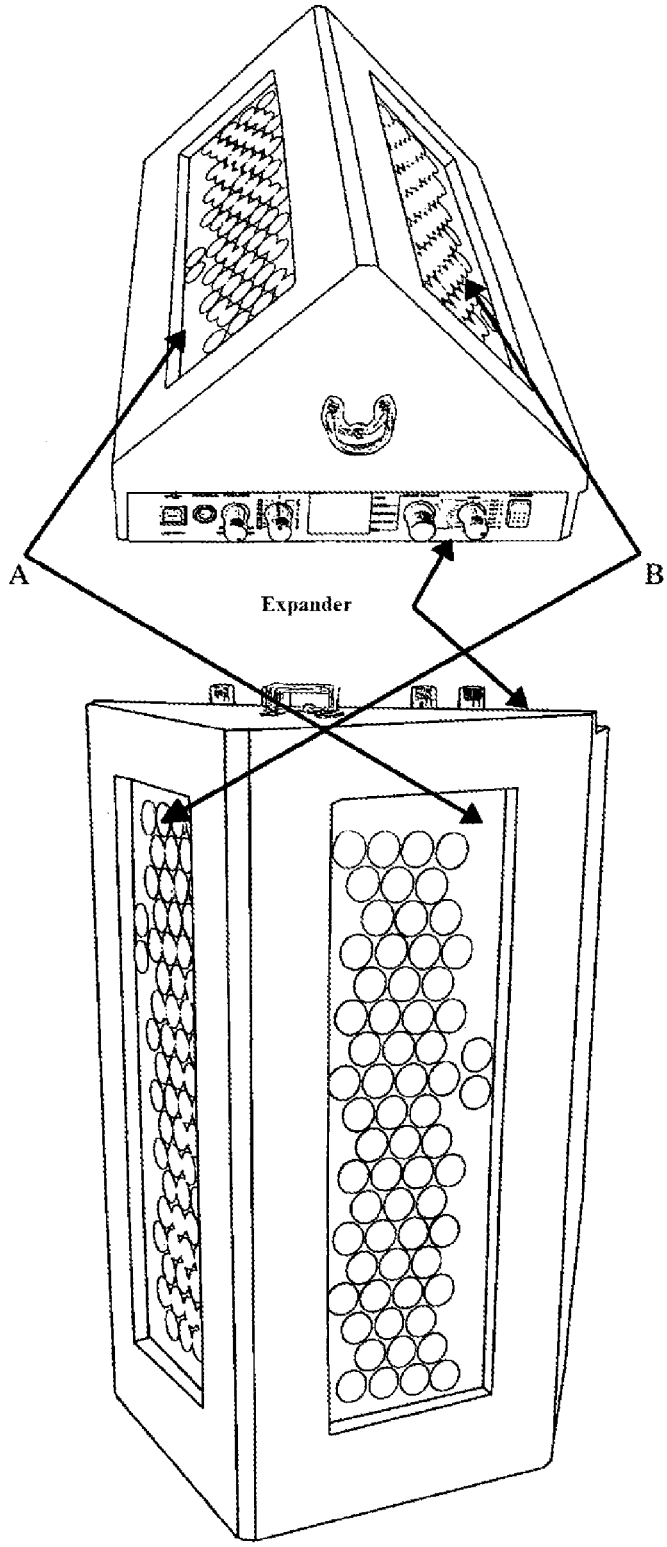

In an embodiment, the instrument includes a housing body on which both under-keyboards are arranged, the housing body being equipped with carrying means such as straps (see FIG. 10).

PRIOR ART

As, by favoring the major Cscale, a piano keyboard does not allow any immediate transposition, several keyboards were thought out to solve this problem.

For example kora and English concertina are known which are two diatonic keyboard instruments. The distribution of the notes on the keyboards of these two instruments is such as the notes are separated and arranged alternatively on both sides of a vertical axis. The present invention is distinguished from these well-known instruments by proposing a keyboard which is a position one (unlike English concertina) and which is chromatic (unlike kora).

Chromatic position keyboards are also known, such as for example the upright keyboard of the button accordion and the keyboard called "Janko" keyboard, which make it possible to visualize the chords but has as a drawback, for example, that it is not possible to play a major third with two conjunct keys, unlike the present invention. The thummer and the harmonic table are also position keyboards, of the type in which a chord corresponds to only one position, but they have both as a drawback that they do not make it possible to play an interval of a ½ tone with conjunct keys, an effect that is often desired by a musician and that can be carried out with the present invention. Moreover, neither accordion nor harmony table respect the alternative distribution of the degrees as in the present invention.

From document FR 2 291 568, a metal bar instrument, such as a vibraphone, is also known which is intended to facilitate the production of chords. The instrument comprises lines of two notes, the lines following one another with intervals of alternatively major or minor thirds. However, this instrument is not of chromatic type because, for a given octave, it did not comprise the seven degrees of the heptatonic scale. With this instrument, the play is thus limited to the production of chords and makes very difficult the performance of melodies.

DISCLOSURE OF THE INVENTION

The fundamental principle of this invention is to represent all the notes of music which are arranged not in a straight line, with ½ tone intervals as for piano, but on two surfaces on each of which, in a harmonic context, each broken line representing a long series of piled up thirds will take shape and the harmonic frames and melodies will be played.

The keyboard according to the invention is composed of two under-keyboards A and B (see FIG. 4), one for the left hand or the left foot, and the other for the right hand or the right foot. The notes are alternatively distributed from one under-keyboard to the other, i.e. they are arranged in thirds on each of them.

The under-keyboard A, respectively B, according to this invention is made up either of all the notes on the line spaces, respectively lines, or of all the notes on the lines, respectively line spaces (see FIG. 8). This remark can prove extremely useful during the reading of a partition, and gives again a meaning to this form of writing which is easily understood by a learner.

The distribution of the keys on each under-keyboard (which is not necessarily flat) can also be clarified in the following way: the keys are located on the paving of an elementary triangle whose apexes are a fundamental note, its minor third and its major third. According to the shape of this elementary triangle, which depends on the choice of the above-defined angles, the present invention can be available in an infinity of possibilities (FIG. 2). In an embodiment of this invention, an elementary triangle is chosen which is equilateral. The arrangement allows the largest density of keys for a given relative distance between the keys. In an embodiment, this elementary triangle is symmetrical from one keyboard to the other in order to respect the symmetry of our hands. The other odd intervals (fifths, seventh, etc . . . ) can be considered as the sum of thirds and can thus be played on only one under-keyboard. In view of the alternative distribution of the degrees on both under-keyboards, an even interval (seconds, fourths, sixths, etc . . . ) is played with two notes which are both located on one of the under-keyboards A and B. Thus, the present invention distinguishes the concept of degree from that of interval value in ½ tones. For example, the position of a diminished fifth interval will not be the same as that of an augmented fourth interval (see FIG. 3). One will notice the distribution of the cycle of the fifths, and thus of the fourths, on a straight line.

Thus, the invention has the advantage of allowing musicians to visualize forms of chords and modes on the instrument rather than a succession of notes, and facilitates in this manner their memorization, which is a phenomenon well-known by guitarists. Thanks to the present invention, the transposition into any tonality boils down to carry out a simple translation and/or a symmetry.

Moreover, a musician playing a keyboard according to the invention can be rhythmically more at ease and can better feel the harmonic rhythm during the performance of a harmonic progression. If the present invention is used with a MIDI controller, for the use of virtual instruments of percussion, another arrangement of the notes on the keyboard is provided in order to take advantage of this side arrangement (see FIG. 7). Thus, the musician will be able to play toms, snare drums and bass drums on a side and cymbals on the other, or possibly on the same side.

Figure 6:
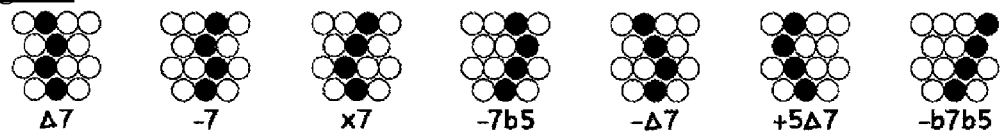

For the best use, the user of this invention will have to know seven basic chord positions, which are the fundamental tetrads (see FIG. 6). The forefinger can be associated to a fundamental note, the middle finger to the third, the ring finger to the fifth and the little finger to the seventh for one hand, and the forefinger to the second, the middle finger to the fourth, the ring finger to the sixth and the little finger to the octave for the other hand. The thumbs can be used to play the low notes. The remainder of the harmonic apparatus can be considered as combinations of these seven basic positions. An elementary triad is a tetrad without its seventh. A chord inversion can be considered as a tetrad played on two octaves, without its most low fundamental note for the first inversion for example. The chords with an added sixth can be considered as inversions. Chord substitutions are located for most of them on the same under-keyboard as the substituted chord. Chord extensions can be considered as a series of tetrads played on the same side (the same under-keyboard), some of their notes being omitted. Moreover, as it is possible to press two keys at the same time, it becomes possible to play an eleventh chord with three fingers only for example. When a chord is played on two octaves, it is then possible to rhythmically play it with both hands, including with the thumbs for the low notes, as a percussionist.

A mode can be considered as the combination of two tetrads, one for each hand, i.e. played on each of both under-keyboards. For example, the major mode is composed of the major seventh tetrad for the first degree and of the minor seventh tetrad for the second degree. The user of this invention then places his/her hands on the under-keyboards according to the form of both tetrads and his/her fingers are then opposite each notes of the mode on a complete octave, ready to play (see FIG. 5). The modes with limited transpositions are also relatively easy to be carried out thanks to the keyboard according to the present invention. This allows the user of the present invention to easily get some dexterity, even virtuosity. It is obvious that it is necessary for a learner to regularly work out his/her instrument but nevertheless the scale work is divided by 6 since the modes are transposable except for a symmetry. Moreover, once a work on a mode is over, the fingering sequence remaining the same, working another mode simply consists in changing the form of the finger position.

According to the present invention, all the notes in a mode has the shape of a broken line its user will follow throughout the melody, as long as the latter remains in this mode. Thus, to make a progression by fourth, it is enough to follow this broken line from the bottom up, two lines by two lines. The progressions by third or fifth are also very visual. At the time of a harmonic progression, two chords of the same parity of degree, and thus with several notes in common, will be played on the same side of the keyboard, whereas two chords of opposed parities of degree, i.e. with few notes in common, are played on both sides of the keyboard. Thus, the user of the present invention feels the harmonic relations between the chords of a harmonic progression as well as, consequently, the harmonic rhythm of a grid.

BRIEF DESCRIPTION OF THE DRAWING FIGURES

In all the figures (except FIG. 7), it is illustrated the point of view of a musician who carries the instrument on his/her belly and who looks from top to bottom (i.e. the most low notes at the bottom). By default, when it is not specified, the fundamental note is taken on the keyboard B of the present embodiment of the invention.

FIG. 1: example in a C tonality of the distribution of the degrees alternatively on two parallel axes.

FIG. 2: example of elementary triangles and corresponding paving. The intervals are represented starting from a fundamental note in FIG. 2.1 with an equilateral triangle, in FIG. 2.2 with a right-angled triangle, in FIG. 2.3 with an unspecified triangle. The circle is used to locate the note and does not determine the shape of the key.

FIG. 3: distribution of the intervals.

FIG. 4: represents a keyboard according to the invention. mod+ and mod− represent the two keys controlling the modulation serrated roller, and pb+ and pb− represent the two keys controlling the pitch bend.

Figure 5:
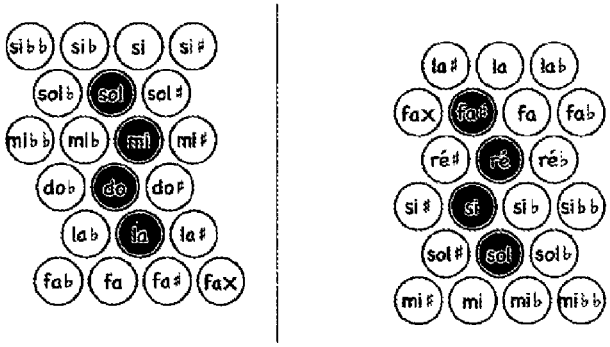

FIG. 5: position of the G major mode.

FIG. 6: position of tetrads in a fundamental position on the keyboard B of the present embodiment.

Figure 7:
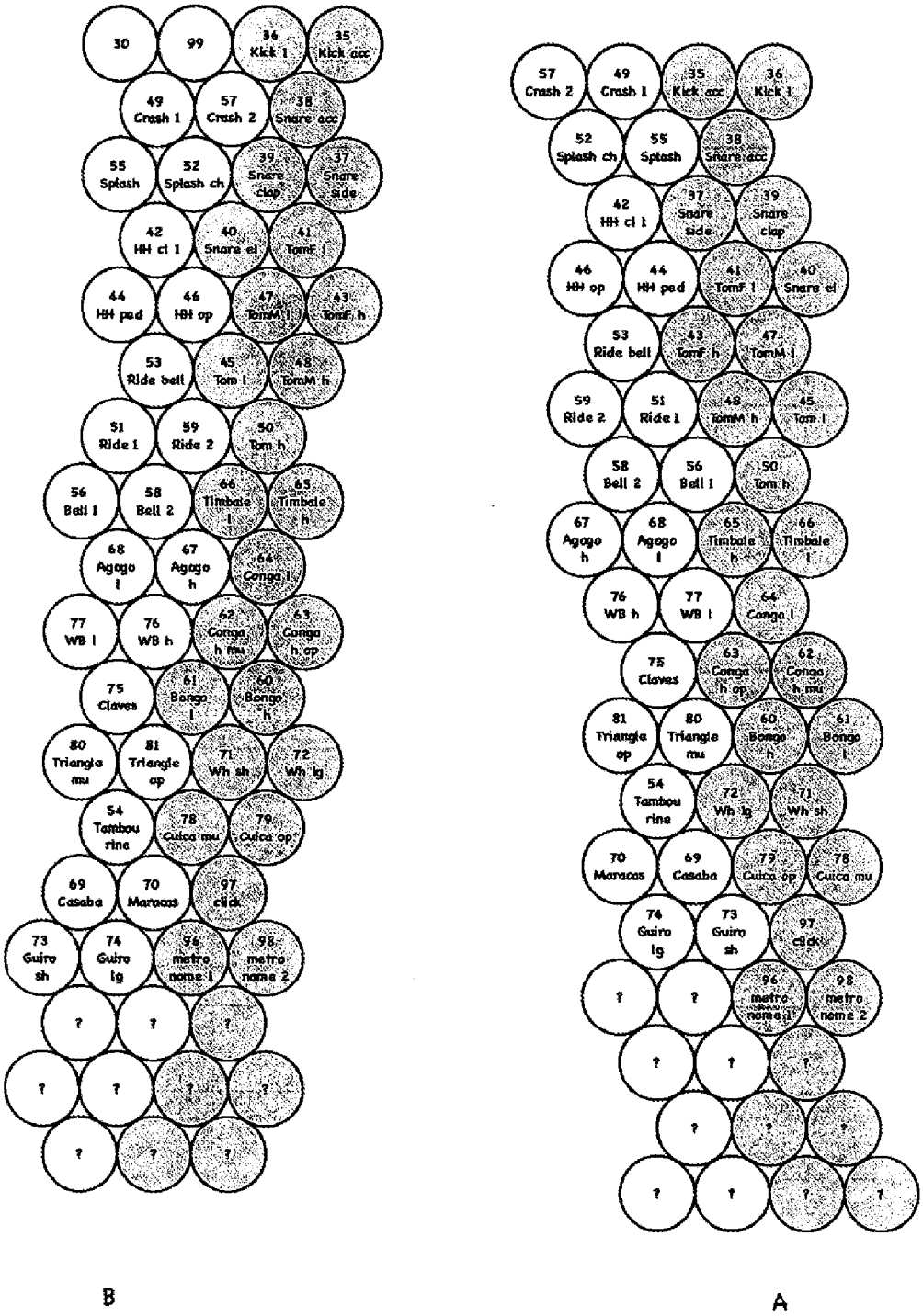

FIG. 7: arrangement of the notes in a "percussions" mode. Caution: the figure is reversed compared to the preceding figures (low notes at the top), because it is a front view.

FIG. 8: representation of the present invention on the musical stave.

FIG. 9: other embodiments of the invention.

FIG. 10: diagram of an embodiment of the present invention, top view and front view.

Figure 11:
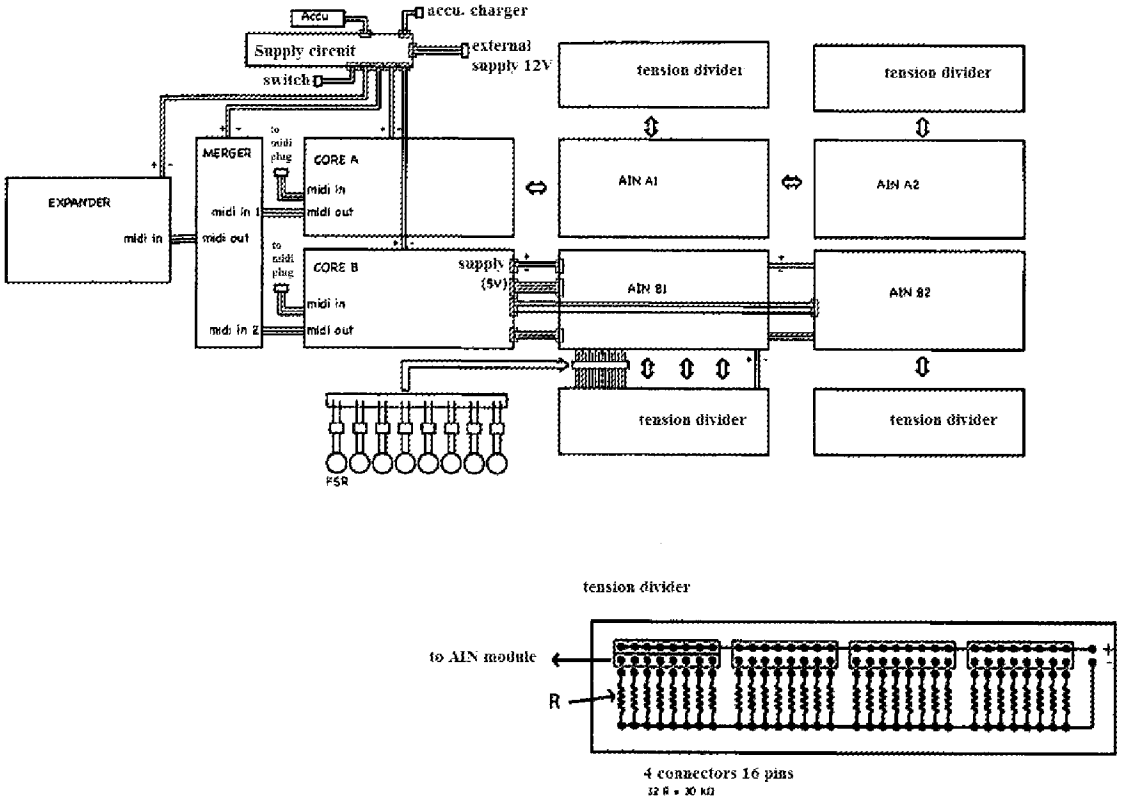

FIG. 11: diagram of the electronic device.

FIG. 12: illustration where the angles are oriented in the anti-clockwise direction.

DISCLOSURE OF AN EMBODIMENT

In the following embodiment, the invention is used on a musical instrument using the MIDI standard. As represented in FIG. 4, one chooses two under-keyboards A and B of 62 notes each, with a range of 5 octaves and 2 tones, by integrating the natural notes, their accidentals as well as the notes Bbb, Ebb and F#. Four keys can be used as pitch bend and modulation serrated rollers. Both under-keyboards are placed according to two perpendicular planes (Ideally, these two planes should be parallel and quite close, but the keyboard would reel under each pressure). Their relative position is such as, if these two planes are projected onto their bisecting plane, each note of one of the keyboards is located between its upward major second and its downward major second on the other keyboard. Thus, in this embodiment in which the keys have a small size and are quite close to each other, the present invention can be adapted to a portable keyboard. The possibility of playing upright offers a considerable advantage for a musician who desires to push himself/herself forward on stage.

The devices controlling the notes of music are composed of pressure sensors placed under small cylinders of relatively soft rubber. Thus, the intensity of the sound directly depends on the force with which the fingers of a musician press the keys (and/or of the swiftness with which one presses the keys). A little stronger pressure after the emission of the note makes it possible to control the aftertouch. Two couples of buttons control the modulation serrated roller and the pitch bend serrated roller.

In this embodiment, the instrument can be carried on the belly thanks to straps. It integrates a MIDI expander. It works on battery and has a 4-hour charge approximately. It can be connected to an amplifier or a headphone and has a MIDI output.

As regards the majority of the keyboards using the MIDI protocol, the choice was made to transmit the intensity of the sound according to the speed (or swiftness) of key depression. This choice can be inconvenient for a musician, insofar as he/she can be encouraged to play quickly in order to play loudly and to play slowly in order to play a weak sound. This embodiment finds a solution for this disadvantage by making the intensity of the note depend on the exerted pressure, the "note on" being started at the time when the pressure is maximum. The pressure on the small rubber cylinder makes for easy playing and requests less energy than a key depression mechanism. Moreover, the material chosen for the keys in the embodiment of the present invention allows the fingers to easily slip from one key to another.

As regards the electronic part (see FIG. 11), a FSR (Force Sensitive Resistor) sensor is a resistor whose resistance varies from 2 MΩ to 1 KΩ according to the pressure thereon. This sensor, placed under the buttons, will convey the intention of the musician to the synthesizer, according to the force with which he/she will press the buttons. This variation of resistance is transformed into a variation of tension, then into a numerical signal. This signal will be then interpreted by a program in order to determine the intensity of the note and the aftertouch value. The tension dividers, as their name indicates it, transforms the variation of resistance (from 2 MΩ to 1 KΩ) of the FSR sensors into a variation of tension (from 5 to 0 V). Two modules, the analog input module (AIN) and the Core module will convert the analog signal (variation of tension between 0 V and 5 V) into a numerical signal, in particular thanks to a microcontroller located on the CORE modules. An application in the microcontroller converts the numerical signal into a MIDI signal, which is then interpreted by the expander. The AIN modules are provided for "matrixing" the analog signals because the Core modules used for the present embodiment have only 8 analog inputs. As each Core module can manage only 64 analog buttons, a merger module mixes the MIDI signals coming from both Core modules into only one signal.

Programming. The PICs (trade name) of both Core modules must be programmed so that they correctly interpret the numerical signals they receive and they transform them into a MIDI signal that can be understood by the expander. Here is given the algorithm which interprets the signals delivered by the unit musician-sensor-converter pressure/tension/numerical signal. When a button is pressed, it sends a signal between 0 and 127 at each variation of pressure. The general idea is to start "the note on" as soon as the pressure (weak or strong) has reached its maximum, provided that a certain threshold has been exceeded so that one can touch lightly the keys without starting a sound. A "note off" signal will be sent as soon as the button is released. Moreover, starting from another threshold, the variation of pressure will always start aftertouch signals according to the pressure exerted by the musician.

Here is given the detailed algorithm of the mode of sending a MIDI message according to the pressure exerted on the keys: as a global variable is declared a table, called "state" table, with 128 boxes, each one corresponding to a button. 0 means that the button is in a "note off" state, 128 means it is in a "note on" state.

When a button is touched, a value, called "value of pressure", between 0 and 127, corresponding to this button, is sent.

If the state of this button is 0:

If the value of pressure is lower than a certain threshold, called "start threshold", nothing occurs. That allows the user to position his/her finger on the keyboard without starting a sound.

If the value of pressure is higher than this threshold, the state takes the value of pressure.

If the state of this button is a number between the release threshold and 126, there are two possibilities: either the value of pressure is higher than the state of the button, i.e. the pressure is still in progress, and in this case the state of the button takes this value, or the value of pressure is lower than the state of the button and the pressure has reached its maximum, and a "note on" message, with this swiftness value, is sent, the state of the button is then 127.

If the state of the button is 127:

If the value of pressure is lower than a certain threshold, called "stop threshold", which can be 0, a "note off" message is sent, and the state of the button becomes 0. Otherwise, if the value of pressure is higher than a certain threshold, called "aftertouch threshold", an aftertouch message is sent the value of which is a number proportional to the difference between 127 and the aftertouch threshold (but lower than 127).

INDUSTRIAL APPLICATION

The present invention is destined to beginners in music who desire to quickly acquire the possibility of playing harmonic progressions (to be able to sing songs and to accompany themselves), or to improvise melodies. It is also destined to experienced musicians and notably to players of wind instruments who would desire to have a tool for visualizing and better understanding harmonic relations between chords. It can also be used in any place of music teaching, and in particular in musical teaching classes. Moreover, if the present invention can be adapted to a portable instrument, it makes for easy playing for a musician on stage and it is thus intended to any musician liking stage business.

The invention claimed is:

1. A keyboard for a musical instrument comprising:

a first under-keyboard; and a second under-keyboard;

wherein each of said first and second under-keyboards includes at least four parallel and equidistant lines, each line including at least one key, the distance between the lines being identical for both under-keyboards;

such that, with respect to a given base key corresponding to a note n located on a line arranged between an adjacent lower line and an adjacent upper line:

on the adjacent upper line, there is at least one of an upward-major key and an upward-minor key with respect to the base key, wherein:

the upward-major-key actuates the upward major third of n, and is arranged so that the line starting from the base key and passing through the upward-major-key forms a first angle, with the line on which the base key is located; wherein, on the first under-keyboard, the measure of the first angle is M and belongs to the interval [0°, 90°], and on the second under-keyboard, the measure of the first angle is −M; and the upward-minor-key actuates the upward minor third of n, and is arranged so that the line starting from the base key and passing through the upward-minor-key forms a second angle, with the line on which the base key is located; wherein, on the first under-keyboard, the measure of the second angle is m and belongs to the interval [90°, 180°], and on the second under-keyboard, the measure of the second angle is −m; and on the adjacent lower line, there is at least one of a downward-major key and a downward-minor key with respect to the base key, wherein:

the downward-major-key actuates the downward major third of n, and is arranged so that the line starting from the base key and passing through the downward-major-key forms a supplementary first angle; wherein, on the first under-keyboard, the measure of the supplementary first angle is M−180°, and on the second under-keyboard, the measure of the supplementary first angle is 180°−M; and the downward-minor-key actuates the downward minor third of n, and is arranged so that the line starting from the base key and passing through the downward-minor-key forms a supplementary second angle; wherein on the first under-keyboard, the supplementary second angle has a measure of m−180°, and on the second under-keyboard, the supplementary second angle has a measure of 180°−m;

and for each key actuating a note q on each of the under-keyboards, there exists on the other under-keyboard at least one of:

a key actuating the upward major second of the note q;

and a key actuating the downward major second of the note q;

so that notes are alternatively distributed from one under-keyboard to the other, while being arranged by thirds on each of them.

2. The keyboard according to claim 1, wherein the under-keyboards are each located on a plane such that, if each of those planes is projected onto a bisecting plane of those two planes, each key corresponding to a note n will be located between the keys corresponding to the upward major second of n and the downward major second of n.

3. The keyboard according to claim 1, wherein M is equal to 60 degrees, and m is equal to 120 degrees.

4. The keyboard according to claim 1, wherein the keys are sensitive to force and/or swiftness of actuation.

5. The keyboard according to claim 4, wherein an electronic device makes it possible to vary an intensity of an emitted sound according to a force and/or swiftness of actuation of the keys.

6. The keyboard according to claim 5, wherein each under-keyboard is arranged on a flat surface and the angle between front faces of the under-keyboards belongs to the interval [180°, 270°].

7. A musical instrument including a keyboard according to claim 1.

8. The musical instrument according to claim 7, wherein the musical instrument comprises a sound generator of an expander type according to the MIDI standard.

9. The musical instrument according to claim 8, further comprising a first device and a second device, wherein the first device makes it possible to vary pitch bend, upward and downward, and the second device controls a modulation serrated roller, which increases and lowers the effect obtained with the first device.

10. The musical instrument according to claim 1, further comprising a housing body, equipped with a carrying element, on which both under-keyboards are arranged.

11. The keyboard according to claim 2, wherein M is equal to 60 degrees, and m is equal to 120 degrees.

12. The keyboard according to claim 2, wherein the keys are sensitive to force and/or swiftness of actuation.

13. The keyboard according to claim 3, wherein the keys are sensitive to force and/or swiftness of actuation.

14. The musical instrument according to claim 8, further comprising a housing body, equipped with a carrying element, on which both under-keyboards are arranged.

15. The musical instrument according to claim 9, further comprising a housing body, equipped with a carrying element, on which both under-keyboards are arranged.

* * * * *